US009279637B2

(12) United States Patent
Hunsaker

(10) Patent No.: US 9,279,637 B2
(45) Date of Patent: Mar. 8, 2016

(54) MUZZLE LOADING RAMROD

(71) Applicant: James Perry Hunsaker, Higley, AZ (US)

(72) Inventor: James Perry Hunsaker, Higley, AZ (US)

( * ) Notice: Subject to any disclaimer, the term of this patent is extended or adjusted under 35 U.S.C. 154(b) by 0 days.

(21) Appl. No.: 14/455,509

(22) Filed: Aug. 8, 2014

(65) Prior Publication Data

US 2014/0345182 A1 Nov. 27, 2014

Related U.S. Application Data

(62) Division of application No. 13/614,876, filed on Sep. 13, 2012, now Pat. No. 8,991,089.

(60) Provisional application No. 61/534,022, filed on Sep. 13, 2011, provisional application No. 61/541,850, filed on Sep. 30, 2011.

(51) Int. Cl.
*F41C 9/08* (2006.01)
*F41A 29/04* (2006.01)

(52) U.S. Cl.
CPC ..... *F41C 9/085* (2013.01)

(58) Field of Classification Search
CPC ..... F41C 9/08; F41C 9/085; F41C 27/00; F41A 29/00; F41A 29/02; F41A 2/04
See application file for complete search history.

(56) References Cited

U.S. PATENT DOCUMENTS 464,099 A 12/1891 Von Wehrstedt
1,192,174 A 7/1916 Dvorak
1,237,056 A * 8/1917 Kitchen ..... F41A 29/02 15/104.16
1,556,494 A 10/1925 Cooper
1,665,988 A * 4/1928 Smith ..... F41A 29/02 15/104.165
3,402,950 A * 9/1968 Hertzberg ..... F41A 29/02 15/104.2
3,710,411 A * 1/1973 Murguiondo ..... 15/104.16
3,747,252 A * 7/1973 Walker ..... 42/90
4,010,565 A * 3/1977 DiProspero ..... 42/106
4,112,606 A * 9/1978 Griffin ..... 42/90
4,327,515 A * 5/1982 Kuryn ..... 42/90
4,407,086 A 10/1983 Hasselmann
4,414,770 A * 11/1983 Brinton, Sr. ..... 42/90
4,466,209 A * 8/1984 Strickland et al. ..... 42/90
4,536,983 A * 8/1985 Fry ..... 42/90
4,571,873 A * 2/1986 Houk ..... 42/90
4,601,125 A * 7/1986 Curtis ..... 42/90
4,817,321 A * 4/1989 Clement ..... 42/90
4,843,747 A * 7/1989 Echeberria ..... 42/90
4,875,303 A 10/1989 DeWeert et al.
4,899,415 A * 2/1990 Wheeler ..... F41A 29/02 15/104.05
4,912,868 A 4/1990 Thompson
5,016,380 A * 5/1991 Jones ..... B25F 1/02 42/90

(Continued)

*Primary Examiner* — Bret Hayes
*Assistant Examiner* — Derrick Morgan
(74) *Attorney, Agent, or Firm* — Schmeiser, Olsen & Watts LLP

(57) ABSTRACT

A ramrod for a muzzleloader is provided. The ramrod includes a shaft having a knob releasably coupled to one end thereof, the knob having a rounded end and a tapered end that oppose one another. The knob may have a central bore therein, and the shaft may be inserted into the central bore. The tapered end of the knob is configured with respect to the shaft to allow any object that contacts the shaft and slides along the shaft to also slide along and eventually off of the tapered end of the knob without snagging or catching the knob. The rounded end of the knob is positioned at a distal end of the shaft and is configured with respect to the shaft to allow a user of the ramrod to place his/her palm against the rounded end while operating the ramrod to load a muzzleloader.

15 Claims, 7 Drawing Sheets

(56) References Cited

U.S. PATENT DOCUMENTS

| | | | | |
|---|---|---|---|---|
| 5,127,179 | A | 7/1992 | Marsh | |
| 5,651,207 | A | 7/1997 | Knight | |
| 5,934,000 | A * | 8/1999 | Hayes, Sr. | 42/95 |
| 6,145,235 | A | 11/2000 | Emerson et al. | |
| RE38,247 | E | 9/2003 | Wisckser, Jr. | |
| 6,637,143 | B1 * | 10/2003 | Wykle | 42/90 |
| 7,441,363 | B1 | 10/2008 | Black et al. | |
| 8,112,932 | B1 * | 2/2012 | Vollmer | F41C 9/085 42/51 |
| 8,925,235 | B2 * | 1/2015 | Buie, II | F41A 29/02 42/90 |
| 2006/0005446 | A1 | 1/2006 | Lee et al. | |
| 2006/0010753 | A1 * | 1/2006 | Buie | 42/95 |
| 2011/0209378 | A1 * | 9/2011 | Johnston | 42/90 |
| 2011/0302818 | A1 * | 12/2011 | Samaras et al. | 42/90 |
| 2013/0061507 | A1 * | 3/2013 | Hunsaker | 42/90 |
| 2013/0091752 | A1 * | 4/2013 | Ervin | 42/90 |
| 2013/0104442 | A1 * | 5/2013 | Hancharick | 42/90 |
| 2013/0283658 | A1 * | 10/2013 | Buie, II | 42/95 |
| 2014/0290112 | A1 * | 10/2014 | Horne | 42/90 |

* cited by examiner

MUZZLE LOADING RAMROD

CROSS REFERENCE TO RELATED APPLICATION[S]

This application is a divisional of U.S. patent application to Hunsaker entitled "MUZZLE LOADING RAMROD," Ser. No. 13/614,876, filed Sep. 13, 2012, currently pending, which claims priority to U.S. Provisional Patent Application to Hunsaker entitled "MUZZLE LOADING RAMROD," Ser. No. 61/534,022, filed Sep. 13, 2011, and to U.S. Provisional Patent Application to Hunsaker entitled "PALM SAVER KNOB FOR MUZZLE LOADING RAMROD," Ser. No. 61/541,850 filed Sep. 30, 2011, the disclosures of which are hereby incorporated entirely herein by reference.

BACKGROUND

1. Technical Field

This disclosure relates generally to muzzle-loading guns and more particularly to a new and improved ramrod for use with muzzleloaders.

2. State of the Art

From cannons to small pistols, muzzle-loading weapons have been in existence for centuries. Generally, a "muzzleloader" is any weapon into which the propellant charge, i.e., gunpowder, and the projectile, i.e., bullet, that is intended to be discharged from the weapon, are loaded into the weapon by way of the muzzle, the muzzle being the forward, open end of the weapon's barrel. A muzzleloader may typically be loaded by inserting a measured amount of propellant charge into the muzzle, followed by the insertion of the projectile into the muzzle. In many cases, wadding, i.e., a piece of fabric, felt, cloth, or card, is placed around the projectile, or at least behind the projectile, such that when the projectile is inserted into the barrel the wadding is positioned between the propellant charge and projectile. Because the projectile and the wadding are generally tight-fitting within the bore of the barrel, a ramrod is utilized to drive the wadding and projectile down the barrel to ensure they are firmly seated on the propellant charge.

Due to the fact that much of the length of the ramrod must be inserted down into the barrel of the weapon to properly load the projectile and propellant charge, the ramrod is necessarily a straight cylindrical rod that has a diameter that is smaller than the bore of the barrel. Further, because the ramrod is an essential component of the muzzleloader, the ramrod may be stored conveniently near the weapon for swift and easy repeat access by the user. In the case of a rifle muzzleloader, specifically, the ramrod may be stored along the underside of the barrel by a clasp or notch into which the ramrod is inserted or otherwise secured. When needed, the user may remove the ramrod by sliding, or otherwise removing the ramrod from the clasp or notch, insert the ramrod into the barrel, repeatedly and violently jam the ramrod up and down within the barrel to properly compact the projectile and propellant charge in the muzzleloader, remove the ramrod from the barrel, and then replace the ramrod into the clasp or notch until needed again.

The straight, cylindrical structure of the ramrod and its relatively violent use in loading the muzzleloader tends to create some difficulty and discomfort to the user. In addition to this discomfort, the interaction between the ramrod and the clasp or notch that secures the ramrod to the muzzleloader may be such that the ramrod may rattle, or otherwise create unwanted noise, especially during situations where the user desires quite, such as during a hunt. Further, when a muzzleloader is repeatedly fired, powder builds up within the barrel and makes it increasingly difficult to load the projectile into the barrel.

Thus, there is a need in the field for one or more devices that can be used with a muzzleloader that address the above-mentioned problems.

SUMMARY

The present disclosure relates to muzzle-loading firearms, and in particular to a new and improved ramrod that not only facilitates the efficient and safe loading of a projectile into the muzzleloader but also reduces the noise generated by the ramrod against the muzzleloader when the ramrod is not in use.

An aspect of the ramrod includes a shaft having a knob releasably coupled to one end thereof, the knob having a rounded end and a tapered end. The tapered end of the knob is positioned near the shaft and is configured with respect to the shaft to allow any object that contacts the shaft and slides along the shaft to also slide along and eventually off of the tapered end of the knob without snagging or catching the knob. The rounded end of the knob is positioned at a distal end of the shaft and is configured with respect to the shaft to allow a user of the ramrod to place his/her palm against the rounded end while operating the ramrod to load a muzzleloader.

Another aspect includes the knob having a indentation axially oriented along the length of the knob. The indentation is semi-circular in shape and has an arc that corresponds to the arc of the exterior of the barrel of a gun with which the ramrod is associated. In this way, when the ramrod is stored along the underside of the barrel, the barrel rests within the indentation of the knob and the indentation engages the barrel to securely hold the ramrod in place and to restrict movement of the ramrod with respect to the barrel. This secured positioning and restricted movement prevents the ramrod from jostling or rattling against the barrel and creating unwanted noise.

Another aspect includes a jag releasably coupled to the shaft on an opposing end of the shaft from the knob. The jag may be a cleaning jag or may be a jag that assists the user in loading the muzzleloader.

Another aspect includes the shaft having indentions running along the axial length of the shaft, the indentions removing a portion of the shaft to cause the ramrod to weigh less. Further, the shaft may include internal bearings that permit a portion of the shaft or the jag attached to the shaft to rotate with respect to the remaining portions of the shaft. In this way, the jag that contacts the bullet within the barrel may spin with the bullet as the bullet spins due to the rifling effects within the barrel.

Another aspect includes a smaller ramrod, such as a bullet starter, having a multi-diametered shaft, such that a first diameter has a diameter more narrow than the internal diameter of the barrel of the gun and is configured to enter the barrel and a second diameter has a diameter that is larger than the internal diameter of the barrel of the gun and is configured to impact the barrel of the gun to prevent the ramrod from penetrating further into the barrel. The bullet starter may further include a tapered ridge, such that the tapered ridge impacts the gun barrel and the tapering of the ridge prevents damage to the barrel.

Another aspect includes the bullet starter having a cylindrical hole aligned transversely to the axial orientation of the ramrod. The cylindrical hole may be configured to engage a distal end of a conventional ramrod to provide a convenient handle.

Another aspect includes a ramrod for a muzzleloader, the ramrod comprising: a shaft having a first end and a second end; and a knob releasably coupled to the first end of the shaft; wherein under the condition that the shaft is releasably coupled to the muzzleloader the knob functionally engages the muzzleloader.

Another aspect includes the knob further comprising: an indentation, the indentation being oriented axially along the length of the knob.

The ramrod of claim 2, wherein the indentation is configured to run along the entire length of the knob.

Another aspect includes wherein the indentation is configured to functionally engage the barrel.

Another aspect includes wherein the indentation is configured to have a concave shape.

Another aspect includes wherein the indentation is arc-shaped and configured to have an arc-radius equal to or larger than an arc-radius of the barrel.

Another aspect includes wherein under the condition that the indentation functionally engages the barrel, the ramrod and the knob are precluded from moving with respect to the barrel.

Another aspect includes the knob further comprising: a rounded end; and a tapered end, wherein the tapered end is configured to face the second end of the shaft and the rounded end is configured to face away from the tapered end.

Another aspect includes wherein the tapered end is configured to taper away from the rounded end.

Another aspect includes wherein the knob further comprises a furrow configured between the tapered end and the rounded end, the furrow being oriented circumferentially about the knob.

Another aspect includes wherein the shaft is hollow.

Another aspect includes wherein the second end of the shaft is configured to have releasably coupled thereto a jag.

Another aspect includes a muzzleloader, the muzzleloader comprising the ramrod of claim 1.

Another aspect includes a bullet starter for a muzzleloader, the bullet starter comprising: a shaft having a first portion and a second portion; and a knob releasably coupled to the second portion, wherein the first portion has a diameter smaller than a diameter of the second portion.

Another aspect includes a ridge between the first portion and the second portion, wherein the ridge tapers from the second portion to the first portion.

Another aspect includes the first portion further comprising: a distal end, wherein an edge portion of the distal end is countersunk.

Another aspect includes wherein the countersunk edge portion is configured to receive a jag therein.

Another aspect includes a bore configured in the second portion, the bore being axially oriented transversely to a length of the bullet starter.

Another aspect includes the knob further comprising: a rounded end; and a tapered end, wherein the tapered end is configured to face the first portion of the shaft and the rounded end is configured to face away from the tapered end, wherein the tapered end is configured to taper away from the rounded end.

The foregoing and other features and advantages of the present disclosure will be apparent from the following more detailed description of the particular embodiments of the disclosure, as illustrated in the accompanying drawings.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms “a”, “an” and “the” include plural referents, unless the context clearly dictates otherwise.

As discussed above, embodiments of the present disclosure relate to muzzle-loading firearms, and in particular to a new and improved device that facilitates the efficient and safe loading of a projectile into the muzzleloader, while at the same time reduces the noise generated by the movement of the ramrod during transport of the muzzleloader.

Figure 1:
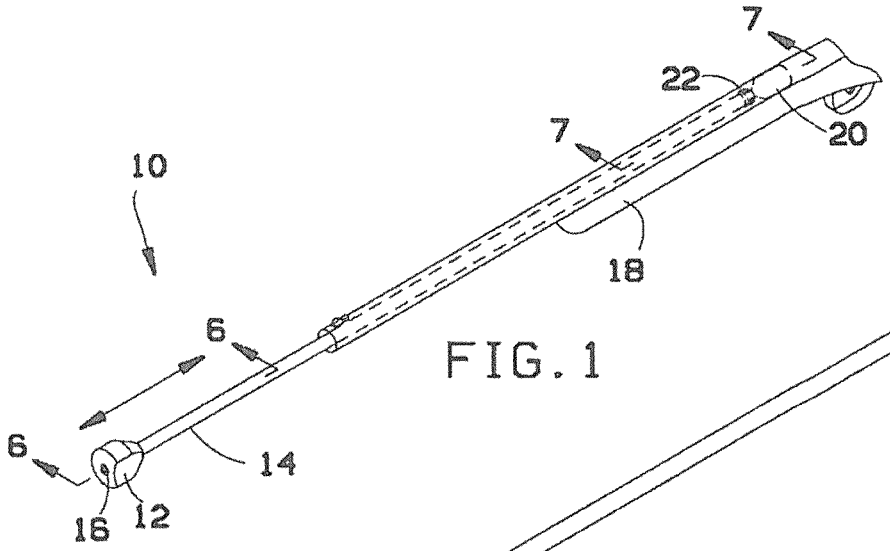
FIG. 1 is a perspective view of an embodiment of a ramrod in use in accordance with the present disclosure.
Figure 2:
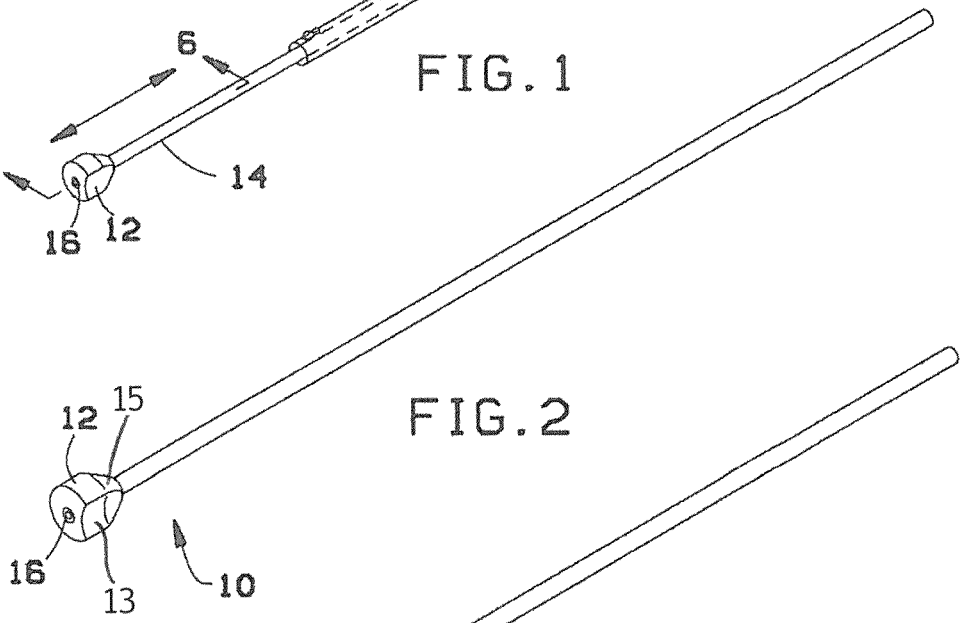
FIG. 2 is a perspective view of the ramrod in accordance with the present disclosure.
Figure 3:
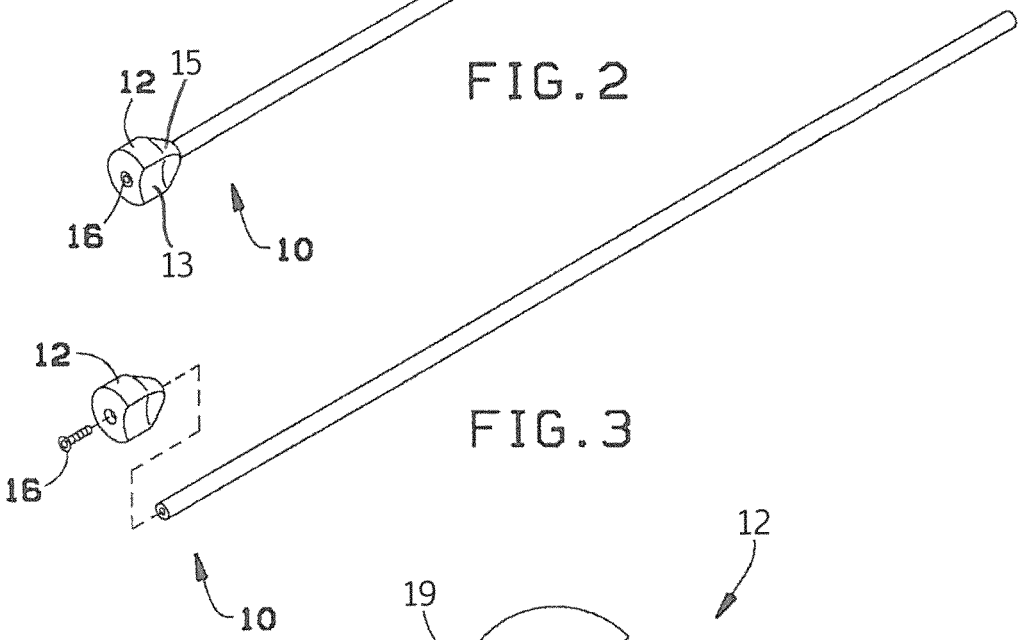
FIG. 3 is a perspective view of the ramrod in accordance with the present disclosure.
Figure 4:
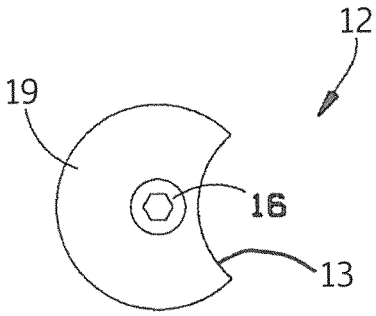
FIG. 4 is a front view of the ramrod in accordance with the present disclosure.
Figure 5:
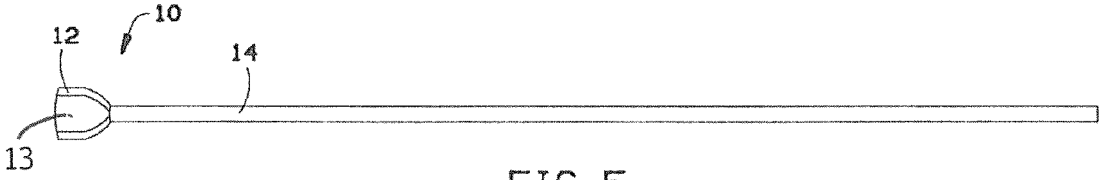
FIG. 5 is a side view of a ramrod in use in accordance with the present disclosure.
Figure 14:
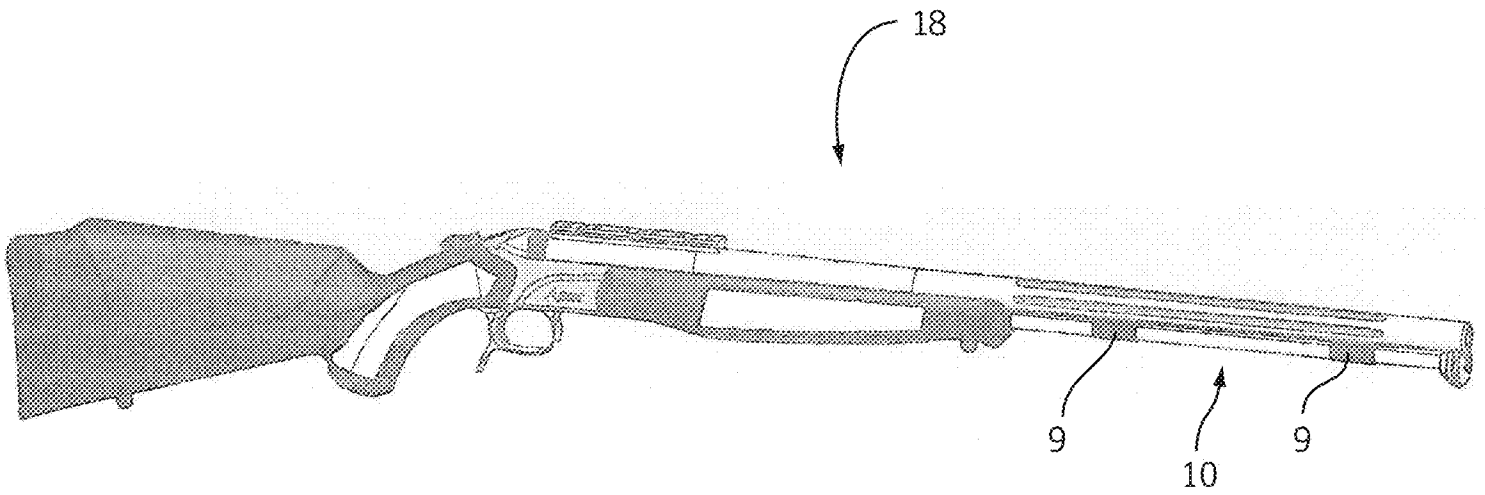
FIG. 14 is a side perspective view of the ramrod stored on the weapon in accordance with the present disclosure.

As shown in FIG. 1, the ramrod 10 may comprise a shaft 14, a knob 12, and a fastener 16. The fastener 16 may be configured to releasably couple the knob 12 to a first end of the shaft 14. The ramrod 10 may be used in association with a jag 22, a weapon 18, such as a rifle or other gun, and a projectile 20, such as a bullet. The shaft 14 may be configured to be inserted within the barrel of the gun 18, as depicted in FIG. 1, to thereby force the bullet 20, the wadding, and the propellant charge, i.e., gunpowder, down the barrel of the gun 18. Specifically, inserting the shaft 14 into the barrel of the gun 18 allows the ramrod 10 to thereafter be forcefully and repeatedly moved up and down within the barrel of the gun 18 to compact the bullet 20, wadding, and charge in close proximity to one another within the barrel. When not in use, the ramrod 10 may be stored along the underside of the barrel of the gun 18, as depicted in FIG. 14.

The shaft 14 may be a straight, cylindrical rod having a diameter at least less than the internal diameter of the barrel of the gun 18. The shaft 14 may have opposing distal ends. In embodiments of the ramrod 10, the distal ends of the shaft 14 may be countersunk and internally threaded to receive a corresponding externally threaded fastener 16, threaded knob 12, threaded jag 22, or other similar component, such as a cleaning jag. In embodiments of the ramrod 10, the distal ends may be externally threaded, so as to receive the internally countersunk threads of a fastener 16, a knob 12, a jag 22, or other similar components, such as cleaning jags.

The shaft 14 may be solid for greater integrity and strength or may be hollow for reduced weight. The shaft 14 may be comprised of soft metal that is not anodized, so that the metal does not mar the bore of the gun 18 when inside the barrel and does not create sparks that might possibly ignite the charge within the barrel. The soft metal material may be T6 aluminum. The shaft 14 may also be configured to have a predetermined length, such that when the shaft 14 is fully inserted within the barrel of the gun up to the knob 12, the bullet 20, the wadding, and the charge are properly positioned within the barrel. Alternatively, the shaft 14 may be notched, or otherwise marked, to indicate when the shaft 14 has been inserted deep enough into the barrel to properly situate the bullet 20, the wadding, and the charge within the barrel.

As depicted in FIGS. 2-6, the fastener 16 may be utilized to releasably couple the knob 12 to one distal end of the shaft 14. The fastener 16 may be inserted completely through a central bore in the knob 12, such that the head of the fastener 16 engages one end of the knob 12, while the threads of the fastener 16 extend beyond the opposing side of the knob 12. Thereafter, the fastener 16 may be threaded into the corresponding internal threads on one of the countersunk distal ends of the shaft 14, thus securing the knob 12 to the shaft 14 by way of the fastener 16. As mentioned above, in embodiments of the ramrod 10, the knob 12 may be releasably coupled directly to the shaft 14 without the assistance or need of the fastener 16. In other words, the knob 12 and shaft 14 may be configured to allow the knob 12 to be threaded onto, or otherwise securely attached, directly to the shaft 14.

Figure 7:
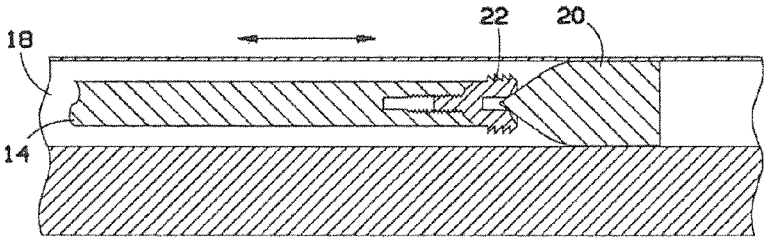
FIG. 7 is a section view of the ramrod taken along line 7-7 in FIG. 1.

The jag 22 may be configured to releasably couple to the shaft 14 at an opposing distal end of the shaft 14 from the knob 12. In other words, the jag 22 and the knob 12 may be releasably coupled to the shaft 14 at opposing distal ends of the shaft 14, such that the jag 22 may be inserted within the barrel of the gun 18 while the knob 12 may remain outside the barrel. In this way, the knob 12 may be utilized to grip the ramrod 10 and thus jam the ramrod 10 up and down within the barrel to compact the bullet 20, the wadding, and the charge in the barrel. The jag 22 may be configured to engage the leading tip of the bullet 20 within the barrel, as depicted in FIG. 7, and displace the bullet 20 within the barrel, as necessary to properly load the muzzleloader. Embodiments of the ramrod 10 also include the jag 22 being a cleaning jag that may be used to clean out the barrel after use.

Figure 6:
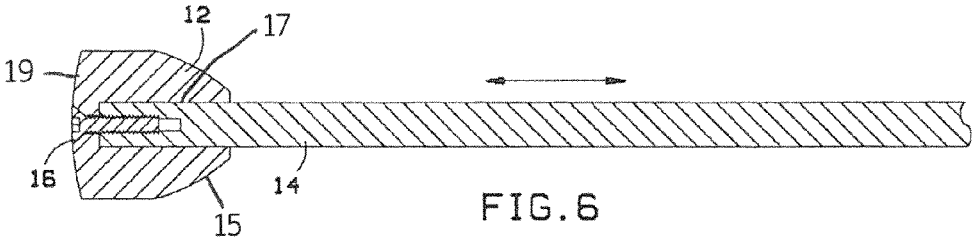
FIG. 6 is a section view of the ramrod taken along line 6-6 in FIG. 1.

With continued reference to FIGS. 2-6, the knob 12 may comprise an indentation 13, a tapered leading edge 15, an internal bore 17, and a rounded end 19. As mentioned above, the knob 12 may be coupled to the shaft 14 by means of a fastener 16 or the knob 12 may be directly coupled to the shaft 14. The knob 12 may further comprise a tapered leading edge 15. As depicted in FIG. 6, the edge of the knob 12 that faces the jag 22 may have the tapered leading edge 15, or an outer surface, that tapers from an initial narrow diameter to a widest diameter of the knob 12. The tapered leading edge 15 may be a smooth taper from the initial diameter to the largest diameter so as to prevent the knob 12 from catching, or otherwise snagging, on another surface, structure, or object. In contrast, conventional ramrods placed and stored below the barrel of the gun 18 usually do not have any structure attached to the conventional ramrod, such as a knob or handle, that the user may use to assist the user in gripping the conventional ramrod to maneuver the conventional ramrod to load the muzzleloader. In fact, conventional ramrods stored below the barrel of the gun 18 are usually straight cylindrical rods without any other grip-like structure attached thereto, because to be able to be stored below the barrel of the gun 18, the ramrod must not have anything attached thereto that might interfere with the pre-established interaction between the built-in securing mechanism 9 on the barrel of the gun 18 and the barrel of the gun 18. The securing mechanism 9 may be a latch, clip, loop, or other means that releasably secures the conventional ramrod below the barrel of the gun 18.

Moreover, other conventional ramrods used to load a muzzleloader may have attached thereto a handle or other gripping means, but these conventional ramrods cannot be stored below the barrel of the gun 18 because they interfere with the pre-established interaction between the securing mechanism 9 on the underside of the barrel of the gun and the barrel of the gun. Also, the protruding handle on these conventional ramrods may snag on objects, such as brush, plants, trees, shrubs, etc. as the user moves through the forest or wild terrain with the gun 18. And, once snagged, oftentimes the conventional ramrod will detach from the user without the user being aware, resulting in the user losing the conventional ramrod and possibly being unable to thereafter properly load the muzzleloader.

To overcome the limitations of the conventional ramrod, the tapered leading edge 15 of the ramrod 10 placed below the barrel of the gun 18 prevents the knob 12 from unsuspectingly catching, or otherwise snagging on foreign objects that might pull the ramrod 10 off of the gun 18. Specifically, if an object comes into contact with the shaft 14 of the ramrod 10 and rides up the shaft 14 to make contact with the knob 12, the object will slide over the tapered leading edge 15 of the knob 12 and off the knob 12 without displacing the ramrod 10 from its stored place under the gun 18. Thus, even as objects brush up against and over the gun 18, the ramrod 10, and the user as the user moves through the brush, forest, or other harsh environment, the ramrod 10 remains in its secured place under the barrel of the gun 18.

Figure 8:
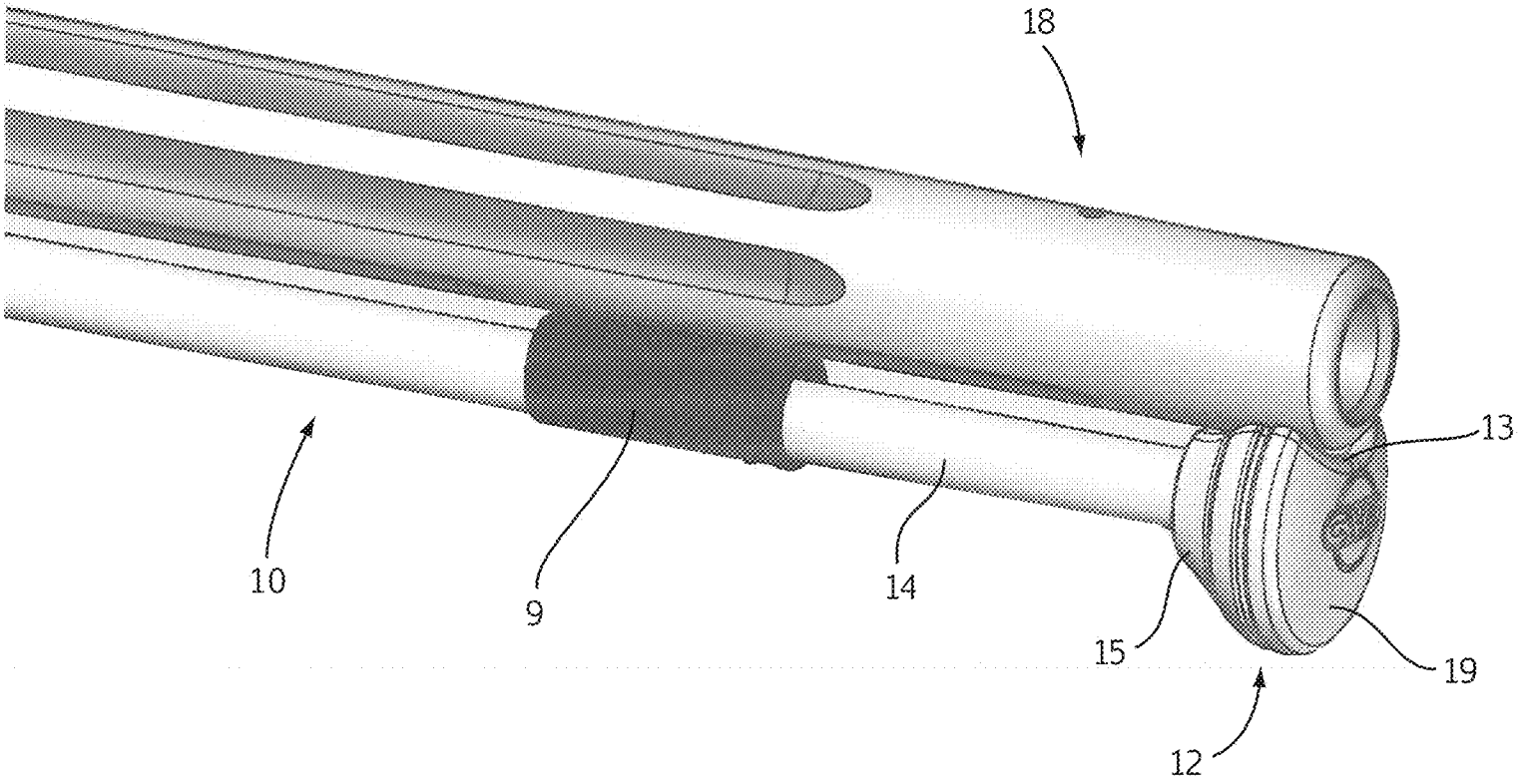
FIG. 8 is a side, perspective view of a portion of the ramrod and a corresponding rifle in accordance with the present disclosure.

Also, to permit the knob 12 to be placed on the distal end of the ramrod 10, embodiments of the ramrod 10 may further include the knob 12 comprising an indentation 13 that runs axially along the length of the knob 12. The indentation 13 may be concave and have an arc radius that is approximate to the arc radius of the external surface of the barrel of the gun 18. In other words, the external arc of the barrel of the gun 18 and the arc of the indentation 13 are comparable. This provides, as depicted in FIG. 8, that the ramrod 10 may be stored in the pre-established state under the barrel of the gun 18. Also, when the ramrod 10 is secured to the underside of the gun 18, in its normal pre-established stored state, the indentation 13 engages the external surface of the barrel of the gun 18 and the barrel of the gun 18 rests within the indentation 13. With the indentation 13 engaging the barrel of the gun 18, the ramrod 10 is prevented from shaking, jiggling, rattling, or otherwise moving, with respect to the barrel. This prevents the ramrod 10 from rattling against the barrel and creating unwanted noise. This is particularly important when the user is hunting game and wishes to be as silent and as stealthy as possible so as to not scare away or otherwise alert the mark. Thus, not only does the indentation 13 on the knob 12 allow the ramrod 10 to have a knob 12 attached thereto and still be placed under the barrel of the gun 18 in its pre-established stored state, but it also prevents the ramrod 10 from rattling against the barrel of the gun 18.

Figure 15:
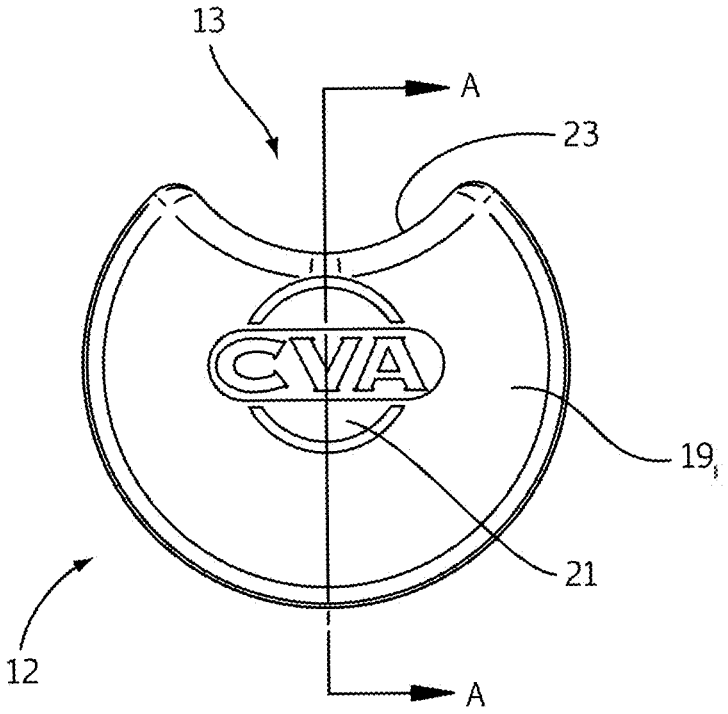
FIG. 15 is a front view of the knob of the ramrod in accordance with the present disclosure.
Figure 16:
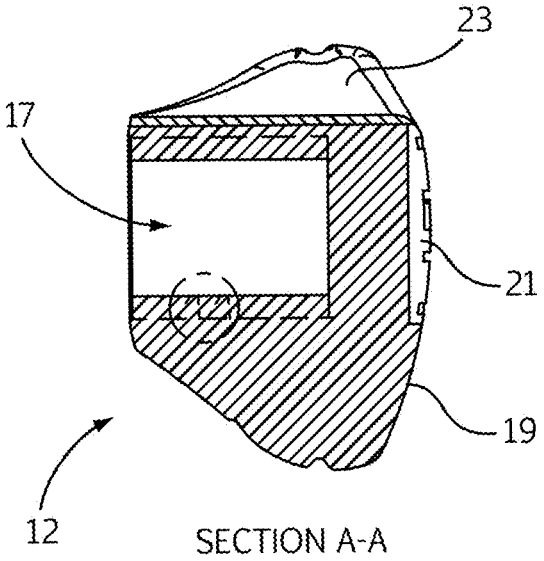
FIG. 16 is a cross-sectional view of the knob of the ramrod, along line A-A in FIG. 15, in accordance with the present disclosure.

As depicted in FIGS. 15 and 16, the knob 12 may be fitted with an interchangeable insert 23 that permits the indentation 13 to be altered by removing the insert 23 from the knob 12 and replacing the insert 23 with a different-sized insert 23. In this way, the size of the indentation 13, such as for example the arc radius of the indentation 13 or the shape of the indentation 13, may be changed or altered dependent upon the size and shape of the gun to which the ramrod 10 and knob 12 will be coupled. As such, multiple inserts 23 may be pre-packaged and sold together and the user may determine which size or shape of insert 23 best suits the particular gun, as needed.

Embodiments of the ramrod 10 further comprise the knob 12 having a furrow 21 in an outer surface of the knob 12. The furrow 21 may be configured in an outermost surface of the knob 12 so as to assist the user in gripping the knob 12 to maneuver the knob 12. The furrow 21 may be configured to run around the circumference of the outermost surface of the knob 12 so as to wrap around the entire circumference of the knob 12.

The knob 12 may further comprise an internal bore 17 that may placed over the distal end of the shaft 14, such that a portion of the shaft 14 slides within the bore 17. In this way, the knob 12 may be more fully secured to the shaft 14 due to the increased contact area between the shaft 14 and the internal bore 17. Moreover, as depicted in FIG. 6, in embodiments of the knob 12 having the internal bore 17, the fastener 16 may be inserted completely through a central bore in the knob 12, such that the head of the fastener 16 engages one end of the knob 12, while the threads of the fastener 16 extend within the internal bore 17. Thereafter, the fastener 16 may be threaded into the corresponding internal threads on one of the countersunk distal ends of the shaft 14 that has been inserted into the internal bore 17, thus securing the knob 12 to the shaft 14 by way of the fastener 16 engaging the shaft 14 within the internal bore 17.

Embodiments of the ramrod 10 further comprise the knob 12 being configured to be placed over a jag 22 that is previously coupled to the shaft 14, the knob 12 having the internal bore 17 that is configured to fit over and enclose the jag 22. The knob 12 may be configured to be releasably coupled directly to the shaft 14 over, or otherwise around, the jag 22. For example, internal threads inside the internal bore 17, as depicted in FIG. 16, may engage corresponding threads on the shaft 14. In the alternative the knob 12 may be configured to be releasably coupled to the jag 22 by press fit arrangement or by the fastener 16 threading into the jag 22. Either way, once the knob 12 is removed from the shaft 14, the jag 22, whether a loading jag or a cleaning jag, is exposed and ready for its suitable use. In other words, embodiments of the ramrod 10 include the knob 12 and the jag 22 being releasably coupled to the same end of the ramrod 10. As mentioned, the jag 22 may be coupled to the internal threads of the shaft 14, whereas the knob 12 over the jag 22 may be coupled to the external threads of the shaft 14.

The knob 12 may further comprise a rounded end 19 positioned on an opposing end of the knob 12 from the tapered leading edge 15. The rounded end 19 may be configured to have a slight convex shape over its surface, so as to conform to the human hand when in the cupping shape. In this way, the user may use the palm of his/her hand to jam the ramrod 10 in and out of the barrel, to properly load the bullet 20 within the barrel, without at all causing discomfort to or damaging the hand. The rounded end 19 may also be configured to receive a logo insert 45 that can be interchanged to display various logos on the knob 12, as desired by the user, as depicted in FIGS. 15 and 16.

Figure 9:
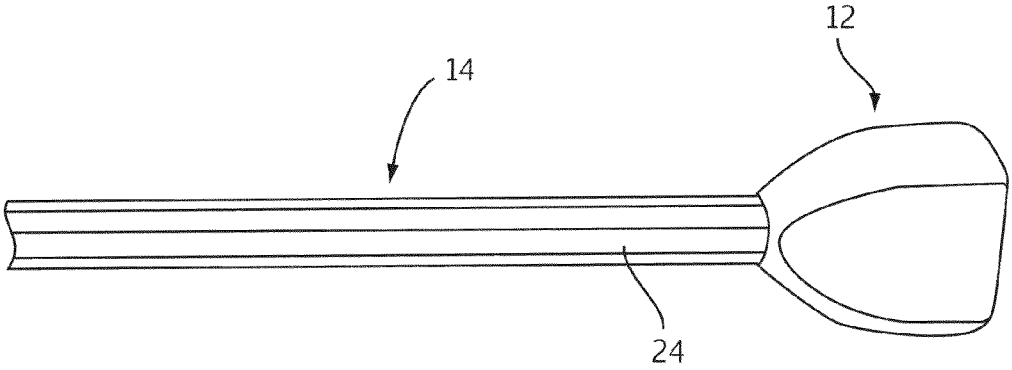
FIG. 9 is a side view of an embodiment of the ramrod in accordance with the present disclosure.
Figure 10:
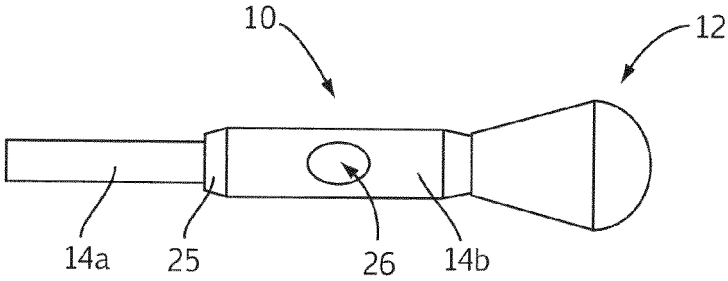
FIG. 10 is a side view of an embodiment of a bullet starter in accordance with the present disclosure.

With reference to FIG. 9, the shaft 14 may further comprise axially-oriented channels 24 running along the length of the shaft 14. The channels 24 may be cut into the shaft 14 to alleviate some of the weight of the shaft 14 to lighten the load on the user when using the gun 18. The channels 24 may run along the entire length of the shaft 14 or for a predetermined distance along the length of the shaft 14 that is not the entire length.

Embodiments of the ramrod 10 further comprise internal bearings (not shown) positioned within the shaft 14 that permit the jag 22 attached to the shaft 14 of the ramrod 10 to rotate within the barrel of the gun 18. Thus, the cleaning jag 22 or the insertion jag 22 may spin within the barrel of the gun 18 in response to cleaning the barrel or in response to inserting the bullet 20, respectively. Specifically, when inserting a bullet 20 within a rifled bore of the barrel of the gun 18, the bullet 20 grips the rifled portions as it transitions down the barrel and spins within the barrel. To maintain sufficient contact with the bullet 20, the internal bearings within the shaft 14 permit the jag 22 to also spin so as to maintain direct contact with the bullet 20. In other words, the shaft 14 of the ramrod 10 may further comprise internal bearings that permit a portion of the shaft 14 or the jag 22 to rotate with the bullet 20 as the bullet 20 travels down the barrel so that the bullet 20 does not spin with respect to the jag 22 because both the jag 22 and the bullet 20 are rotating together at the same rate. In this way, the jag 22 may remain in better contact with the bullet 20. Moreover, it is easier to push the bullet 20 down into the proper operating position because the rotating jag 22 does not have to fight with the bullet 20 as the bullet 20 twists within the barrel, but instead twists with the bullet 20. As for the cleaning jag 22, the internal bearings of the shaft 14 allow the jag 22 to spin, as needed, with respect to the shaft 14 within the barrel in response to forces acting on the jag 22 within the barrel such that the jag 22 does not snag or otherwise get stuck within the barrel as the jag 22 travels up and down the barrel to clean the barrel.

With reference to FIGS. 10-13, embodiments of a ramrod 10 may include a ramrod that is configured to start a projectile 20 down the barrel of a gun. Such a ramrod 10 may be a bullet starter 30 and may comprise a shaft 14 having a first portion **14*a* that has a smaller diameter than the diameter of a second portion 14*b*, with a tapered ridge 25 therebetween, as depicted with reference to FIG. 10. The bullet starter 30 may have a leading first portion 14*a* that has a diameter that is smaller than the internal diameter of the barrel of the gun 18. The second portion 14*b* may have a diameter that is not only larger than the diameter of the first portion 14*a*, but is also larger than the internal diameter of the barrel of the gun 18. The tapered ridge 25 may transition the diameter of the first portion 14*a* to the diameter of the second portion 14*b*. Embodiments of the bullet starter 30 may further comprise a knob 12 releasably coupled to the second portion 14*b*. A user may therefore use the ramrod 10 to insert the projectile, or bullet, 20 down the barrel of the gun 18**.

After the muzzleloader has been repeatedly used to shoot projectiles 20 therefrom, powder residue may build up inside the barrel of the gun 18 thus making it difficult to subsequently load the gun 18. The bullet starter 30, depicted in FIGS. 10-13 may be utilized to start the difficult process of loading a bullet 20 through gun powder residue within the barrel. Oftentimes, significant force is required to initially start the bullet 20 down the gun-powdered impeded barrel. The structure of the bullet starter 30 allows the user to exert the necessary force required to start the bullet 20 down the barrel, without fear that the user's knuckles will violently collide with the barrel once the bullet 20 begins its decent down the barrel. The increased diameter of the second portion 14*b* prevents the bullet starter 30 from proceeding further down the barrel, thus preventing the user's hand that is on the knob 12 from contacting the barrel. Specifically, once the bullet starter 30 forces the bullet 20 down through the initial gun powder and into the barrel, the tapered ridge 25 contacts the barrel and prevents further axial movement of the bullet starter 30 toward the gun 18. Thus, the user's knuckles and hands that are around the knob 12 are prevented from hitting the barrel. In stark contrast to the structure of the bullet starter 30, conventional ramrods do not comprise a tapered ridge or multi-diameter shafts that might otherwise prevent further axial movement of the conventional ramrod down the barrel. In other words, use of conventional ramrods more often than not results in the user's hand and/or knuckles violently impacting the barrel after the user has exerted the requisite force to start the bullet 20 down the barrel.

Figure 11:
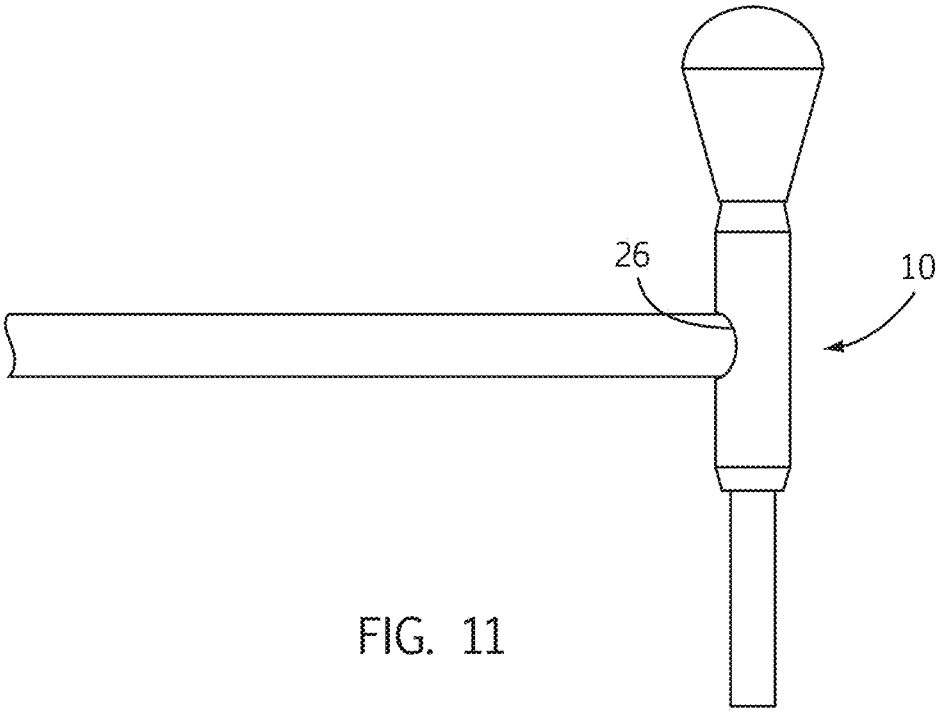
FIG. 11 is a side view of an embodiment of the bullet starter releasably coupled to a conventional ramrod in accordance with the present disclosure.

Embodiments of the ramrod 10 and bullet starter 30 further comprise that once the bullet 20 has been started down the barrel using the bullet starter 30, the user may utilize the ramrod 10 of the present disclosure with the bullet starter 30 of the present disclosure to fully insert the bullet 20 down into the barrel. The bullet starter 30 of FIG. 10 may comprise a circular bore 26 that is axially oriented transversely to the axial length of the bullet starter 30. The circular bore 26 may be configured to receive the shaft 14 of the ramrod 10, or another conventional ramrod that does not have a knob 12 on the distal end thereof. Such a structural configuration allows the circular bore 26 of the bullet starter 30 to engage the distal end of another conventional ramrod, as depicted in FIG. 11, to provide a useful handle that may be utilized to jam the shaft of the ramrod 10 or the conventional ramrod down into the barrel of the gun 18 to properly load the bullet 20, the wadding, and the charge within the muzzleloader 18. With the circular bore 26 being configured in a center portion of the bullet starter 30, the bullet starter 30 may be better balanced on the ramrod 10 or conventional ramrod when used to insert the bullet 20. Moreover, with the circular bore 26 being configured in a center portion of the bullet starter 30, the bullet starter 30 may more conveniently spin, or otherwise move, about the shaft 14 or another conventional ramrod.

Figure 12:
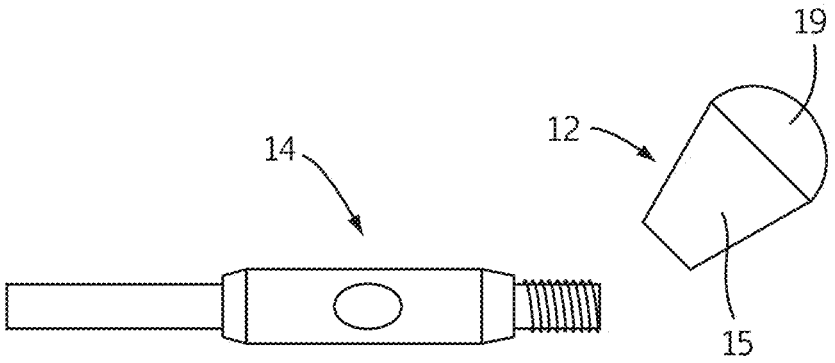
FIG. 12 is a perspective view of the bullet starter in accordance with the present disclosure.
Figure 13:
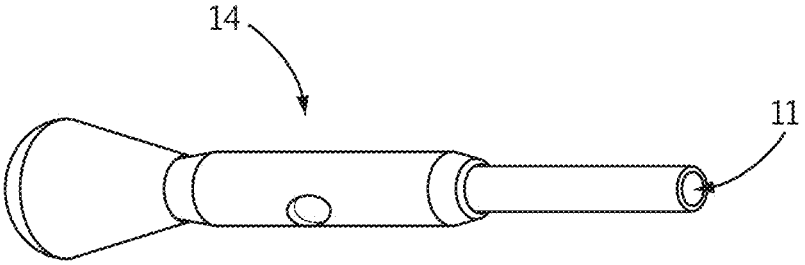
FIG. 13 is a side perspective view of the bullet starter in accordance with the present disclosure.

Embodiments of the bullet starter 30 further comprise the knob 12 being detachable from the bullet starter 30, as depicted in FIG. 12. Specifically, as mentioned above, the knob 12 may be internally threaded so as to thread over the corresponding threads on the shaft 14. Embodiments of the bullet starter 30 further comprise a leading edge 11 of the ramrod being countersunk to better engage the bullet 20 to be inserted within the barrel, as depicted in FIG. 13. The leading edge 11 may further be threaded to receive a jag 22 or other cleaning jag. The countersunk portion being substantially conical so as to mate with a bullet 20. Where there is internal threading the apex or nose of the cone is open and an internally threaded channel extends from the apex further down the shaft 14.

While this disclosure has been described in conjunction with the specific embodiments outlined above, it is evident that many alternatives, modifications and variations will be apparent to those skilled in the art, as evident in the attached Appendix, the disclosure of which is incorporated herein in its entirety. The preferred embodiments of the present disclosure as set forth above are thus intended to be illustrative, not limiting. Various changes may be made without departing from the spirit and scope of the present disclosure, as required by the following claims. The claims provide the scope of the coverage of the present disclosure and should not be limited to the specific examples provided herein.

The invention claimed is:

1. A bullet starter for a muzzleloader, the bullet starter comprising:

a shaft having a first portion and a second portion;

a knob releasably coupled to the second portion, wherein the first portion has a diameter smaller than a diameter of the second portion;

a circular bore configured in the second portion, the bore being axially oriented transversely to a length of the bullet starter and having a tapered surface extending from an outer surface of the second portion; and a ram rod, wherein an end of the ram rod is received within the bore, wherein the tapered surface directs the end of the ram rod into the bore, and wherein the bullet starter may spin or otherwise move about the ramrod.

2. The bullet starter of claim 1, further comprising:

a ridge between the first portion and the second portion, wherein the ridge tapers from the second portion to the first portion.

3. The bullet starter of claim 2, wherein the tapered ridge contacts a barrel of a muzzleloader to prevent further axial movement of the bullet starter when inserting the first portion in the barrel.

4. The bullet starter of claim 1, the first portion further comprising:

a distal end, wherein an edge portion of the distal end is countersunk.

5. The bullet starter of claim 4, wherein the countersunk edge portion is configured to receive a jag therein.

6. The bullet starter of claim 4, further comprising a bullet, wherein the countersunk edge portion engages the bullet to be inserted within a barrel of the muzzleloader.

7. The bullet starter of claim 4, wherein the countersunk edge portion is conical.

8. The bullet starter of claim 1, wherein the bullet starter operates as a handle to push the ram rod into a barrel of a muzzleloader.

9. The bullet starter of claim 1, the knob further comprising:

a rounded end; and a tapered end, wherein the tapered end is configured to face the first portion of the shaft and the rounded end is configured to face away from the tapered end.

10. The bullet starter of claim 9, wherein the tapered end is configured to taper away from the rounded end.

11. A bullet starter for a muzzleloader, the bullet starter comprising:

a shaft having a first portion and a second portion, wherein the first portion has a diameter smaller than a diameter of the second portion;

a knob releasably coupled to the second portion;

a ridge between the first portion and the second portion, wherein the ridge tapers from the second portion to the first portion, and the tapered ridge contacts a barrel of a muzzleloader to prevent further axial movement of the bullet starter when inserting the first portion in the barrel;

a circular bore configured in the second portion, the bore being axially oriented transversely to a length of the bulled starter;

a ram rod, wherein an end of the ram rod is received within the bore, wherein the tapered surface directs the end of the ram rod into the bore, and wherein the bullet starter may spin or otherwise move about the ramrod; and a bullet, wherein:

the first portion of the shaft further comprises a distal end, wherein an edge portion of the distal end is countersunk; and the countersunk edge portion engages the bullet to be inserted within the barrel of the muzzleloader.

12. The bullet starter of claim 11, wherein the countersunk edge portion is configured to receive a jag therein.

13. The bullet starter of claim 11, wherein the countersunk edge portion is conical.

14. The bullet starter of claim 11, wherein the bore includes a tapered surface extending from an outer surface of the second portion, wherein the tapered surface directs the end of the ram rod into the bore.

15. The bullet starter of claim 14, wherein the bullet starter operates as a handle to push the ram rod into a barrel of a muzzleloader.

* * * * *